United States Patent [19]

Eichholz et al.

[11] 3,944,145

[45] Mar. 16, 1976

[54] GRINDING MILL WITH EXCITATION MEMBER IN THE CHARGE OF MATERIAL TO BE COMMINUTED

[75] Inventors: Günter Eichholz, Cologne; Peter Wehren, Krefeld, both of Germany

[73] Assignee: Klockner-Humboldt-Deutz AG, Cologne, Germany

[22] Filed: Jan. 22, 1974

[21] Appl. No.: 435,584

Related U.S. Application Data

[63] Continuation-in-part of Ser. No. 269,320, July 6, 1972, abandoned, which is a continuation-in-part of Ser. No. 115,386, Feb. 16, 1971, abandoned.

[52] U.S. Cl. ..... 241/23; 241/66; 241/172; 241/175

[51] Int. Cl.[2] ..... B02C 17/14

[58] Field of Search ..... 241/66, 170, 172, 174, 241/176, 179, 23, 175

[56] References Cited

UNITED STATES PATENTS

| | | | |
|---|---|---|---|
| 2,171,115 | 8/1939 | Kiesskalt et al. | 241/175 |
| 2,466,443 | 4/1949 | Klassen | 241/66 |
| 2,507,917 | 5/1950 | Lowngren | 241/176 X |
| 2,580,541 | 1/1952 | Hall | 241/176 X |
| 2,822,987 | 2/1958 | Uhle | 241/172 |

FOREIGN PATENTS OR APPLICATIONS

| | | | |
|---|---|---|---|
| 523,358 | 4/1955 | Italy | 241/170 |
| 738,397 | 7/1966 | Canada | 241/172 |

*Primary Examiner*—Roy Lake
*Assistant Examiner*—E. F. Desmond
*Attorney, Agent, or Firm*—Herbert L. Lerner

[57] ABSTRACT

Grinding mill including at least one container partially filled with grinding media, and at least one excitation member extending in direction of the longitudinal axis of the container and disposed within the container so as to be surrounded by the grinding media received in the container; the excitation member being supported on the wall of the container by a plurality of individual rod-shaped support elements extending substantially radially from the excitation member and disposed in spaced relationship to one another in direction of the longitudinal axis.

17 Claims, 8 Drawing Figures

FIG. 1
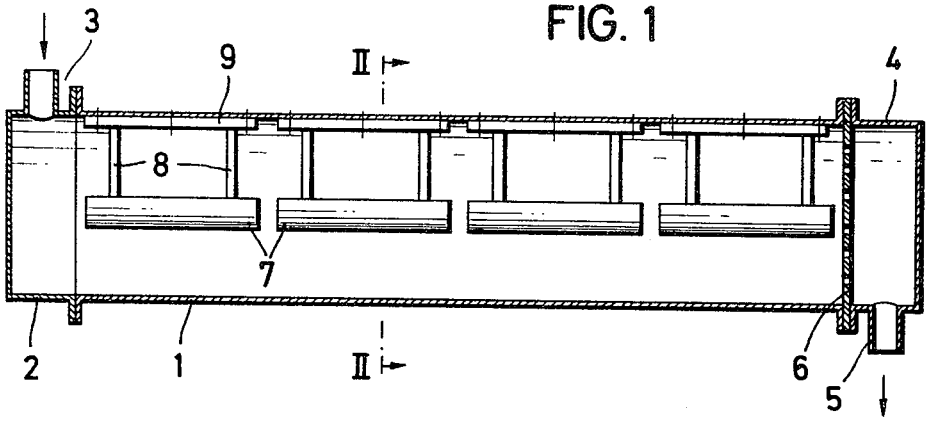
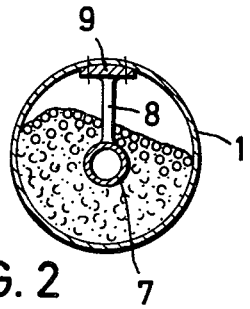
FIG. 2
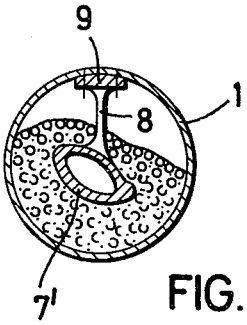
FIG. 3

GRINDING MILL WITH EXCITATION MEMBER IN THE CHARGE OF MATERIAL TO BE COMMINUTED

This application is a continuation-in-part of our application Ser. No. 269,320, filed July 6, 1972, now abandoned, which is a continuation-in-part of our application Ser. No. 115,386, filed on Feb. 16, 1971, now abandoned, and relates to a grinding mill having at least one crushing container or chamber partially filled with comminuting or grinding media, such as balls, punchings, pebbles, rods or the like, and at least one excitation member extending in direction of the axis of the container and disposed in the interior space of the container.

Grinding mills to which the present invention is directed comminutes material introduced into the grinding mill by agitation or movement of grinding media partially filling a compartment of the grinding mill. The grinding media may be balls, punchings, pebbles or rods which rotate, revolve, tumble and travel thereby powdering or pulverizing the material by pressure and abrasion. Grinding mills having a container with a compartment partially filled with grinding media with movement of the grinding media, generally by rotations or vibration or oscillation of the container, to pulverize material are well known in the art and referred to as tumbling, ball, rod, pebble, tube and vibrating or oscillating mills.

In grinding mills, the comminuting action, due to damping caused by the material being comminuted, diminishes radially inwardly from the outer wall of the container, so that with respect to the volume of the comminuting space within the container, the effective comminuting efficiency or output, especially for very large comminuting container diameters, is unsatisfactory. An attempt has therefore been made, heretofore, to locate a so-called center tube in the comminuting container parallel to the longitudinal axis of the latter so that it lay within the charge of material to be comminuted. It was thereby possible, in fact, to transmit with equal intensity, the vibratory or oscillatory movement of the comminuting chamber also to the interior region of the charge of material to be ground. Since such center tubes, however, could be welded or screwed to the comminuting container only at the ends thereof, they tended to break off after a short period due to the heavy stresses imposed thereon during operation of the grinding mills.

A grinding mill is known from German Pat. No. 678,779 which has a member for transmitting the oscillating movement of the comminuting container that is formed preferably of guide plates disposed in the form of a star. This heretofore known transmission member is elastically or resiliently secured at the ends of the comminuting container and, in turn, carries the bearing system for the driving imbalance shaft of the grinding mill. By means of the elastically or resiliently mounted bearing system, the patentee sought to have the transmission member oscillate relative to the comminuting container. The transmission member, therefore, had to be of such dimensions that the guide plates thereof did not come into contact with the wall of the comminuting container. Since the energy required for the comminuting action in this grinding mill of the German patent, is transmitted substantially solely through the transmission member to the charge of material to be comminuted in the grinding mill, the transmission member is subjected to especially heavy wear and tear. This construction of the known transmission member is relatively complex and costly primarily because of the bearing system and the connection to the imbalance shaft. Therefore, the exchange of a worn transmission member requires considerable expense both in terms of time as well as money.

Furthermore, German Published Application No. 1,247,823 discloses a grinding mill, into the comminuting tube or compartment of which there are loosely inserted plate shaped cleaning members having sharp-edged margins which are supposed to prevent accretions or incrustations on the wall of the comminuting tube. No increase in the comminuting action in the interior of the charge of material to be comminuted is achieved thereby, however.

It is accordingly an object of the invention to provide grinding mill with excitation member within the charge of material to be comminuted which avoids the foregoing disadvantages of the heretofore known devices of this general type.

In accordance with further and more specific objects of the invention such a grinding mill is provided with an excitation member which will not readily break away from its connection to the wall of the grinding mill during operation of the latter as does the aforementioned transmission member, and which furthermore increases the comminuting action within the charge of material to be comminuted.

Other objects of the invention are to support the excitation member in the container at locations most favorable with respect to the stresses imposed thereon and, furthermore, to support a relatively longer excitation member at more than two locations.

With the foregoing and other objects in view, there is provided, in accordance with the invention, grinding mill having at least one container partially filled with grinding media, and at least one excitation member extending in direction of the longitudinal axis of the container and disposed within the container so as to be surrounded by the grinding media received in the container, the excitation member being supported on the wall of the container by a plurality of separate rod-shaped support elements extending substantially radially from the excitation member and disposed in spaced relationship to one another in direction of the longitudinal axis.

In accordance with another feature of the invention, the grinding mill has at least two support elements that are disposed in a common plane extending in longitudinal direction of the excitation member, the support elements being firmly though releasably fastened to the wall of the container.

In accordance with a further feature of the invention, instead of providing the excitation member with a conventional tubular cross section, we provide it with a cross-sectional shape substantially conforming to the shape of the volume occupied by the charge of the material to be comminuted in the travel path thereof during operation of the grinding mill. The advantage of this last-mentioned cross-sectional shape of the excitation members is that they may be individually and rapidly exchanged when worn and that the movement of the comminuting or grinding media is not obstructed by the support elements. When the cross-sectional shape of the excitation member is accommodated to or conforms with the circulating travel of the grinding media, wear and tear of the excitation member is reduced to a minimum.

In accordance with other features of the invention, there is provided a grinding mill, especially of the type having a circular cylindrical crushing container or chamber, wherein a plurality, such as three, for example, support elements are disposed in a common plane extending in longitudinal direction of the excitation member and are distributed uniformly about the periphery of the excitation member for supporting the excitation member on the inner surface of the crushing compartment wall free of any firm connection thereto. Due to this construction of the excitation member, the exchange of worn excitation members is even further simplified, because such an excitation member need only be slid into the interior of the mill. Since the excitation member is disposed, free of any firm connection, within the crushing container or chamber, there is little wear on the rod-shaped or crosspiece-shaped support elements because, due to the circulatory movement of the grinding media charge, the excitation member can follow the circulatory movement of the grinding media.

In accordance with an added feature of the invention, the excitation member which is supported on the inner surface of the wall of the container free of any connection thereto, is provided at the ends of the support elements thereof, that are in engagement with the inner surface of the wall, with respective base members of wear-resistant material, such as rubber, plastic material or the like. In this way, the region of the inner surface of the container wall with which the support elements are in engagement are protected against wear.

Other features which are considered as characteristic for the invention are set forth in the appended claims.

Although the grinding mill of the invention is illustrated and described herein as embodied in a grinding mill with excitation member in the charge of material to be comminuted, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a longitudinal sectional view of a grinding mill in the form of a vibrating mill of the tube type constructed in accordance with the invention of the instant application with a multiplicity of excitation members firmly supported at the longitudinal wall of the mill container;

FIG. 2 is a cross-sectional view of FIG. 1 taken along the line II—II in the direction of the arrows;

FIG. 3 is a view similar to that of FIG. 2 of a modified form of the invention wherein the cross-sectional shape of the excitation member substantially conforms to the volume of the grinding media as they travel about within the mill container;

Figure 5:
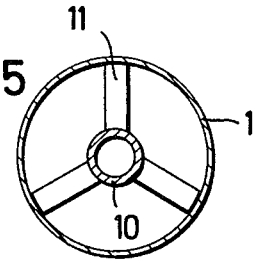
FIG. 5 is a cross-sectional view of FIG. 4 taken along the line V—V in the direction of the arrows.
Figure 6:
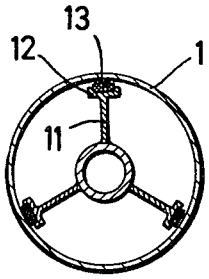
FIG. 6 is a view similar to that of FIG. 5 of a modified form of the invention wherein the support elements of the excitation members are provided with bases formed of wear-resistant material.
Figure 7:
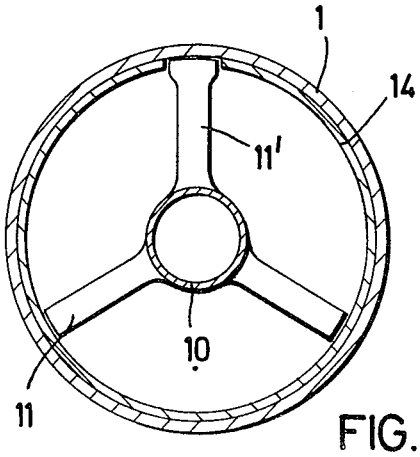
Figure 8:
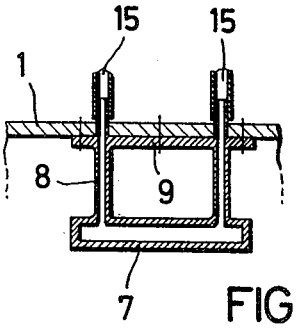

FIG. 7 is a much-enlarged cross-sectional view similar to those of FIGS. 5 and 6 of a further modified form of the invention wherein a cylindrical member of wear-resistant material formed with an axially extending gap is in engagement with the inner surface of the mill container, and one of the support elements of the excitation members is retained within the gap; and FIG. 8 is a fragmentary view of FIG. 1 showing one of the excitation members in longitudinal section with supply and discharge lines for a heat transfer medium, such as heating or cooling fluid, connected thereto.

Referring now to the drawings and first, particularly, to FIG. 1 thereof, there is shown therein in longitudinal section a crushing or grinding tube 1 of a grinding mill in the form of a vibrating mill of the tube type constructed in accordance with the invention, which is provided with excitation members 7 that are firmly secured to the wall of the crushing tube or container 1. The crushing tube 1 is closed at one of the ends thereof by an inlet chamber 2 provided with a material inlet tube 3, and at the other end thereof with a material outlet tube 5. The outlet chamber 4 is separated from the crushing tube 1 by a perforated partition 6 so that the comminuting or grinding media (not shown in FIG. 1) and insufficiently ground material in the crushing tube 1 are retained in the latter while the adequately comminuted material is able to pass through the perforations of the perforated partition 6 into the outlet chamber 4 and consequently discharge from the latter through the outlet tube 5.

A multiplicity of the excitation members 7, for example, four in number in the embodiment of FIG. 1, are located one behind the other in the vicinity of the central axis of the crushing tube, preferably just below the central axis thereof and extending in the direction of the central axis. The excitation members 7 are firmly secured, though with a releasable connection for example by means of a screw connection, respectively to the upper side of the cylindrical crushing tube wall with two radially upwardly directed support elements 8 which are connected to one another at the free ends thereof through a base plate 9.

In the cross-sectional view of FIG. 2, the position of the excitation members 7 with respect to the comminuting or grinding media, such as the balls 16, is shown. In order to save weight, the excitation members 7 are of hollow construction and are closed respectively at the ends thereof. Instead of employing excitation members 7 with circular cylindrical sections as shown in the embodiment of FIG. 2, the excitation members 7′ shown in cross section in FIG. 3 of the drawings have a special constructions in accordance with the invention, namely, the cross-sectional shape thereof is conformed substantially to the shape of the volume of the comminuting or grinding media 16 as they carry out their revolving or circular travel motion during operation of the vibrating mill. Also for the purpose of limiting the weight thereof, the excitation members 7′ have a hollow construction.

Figure 4:
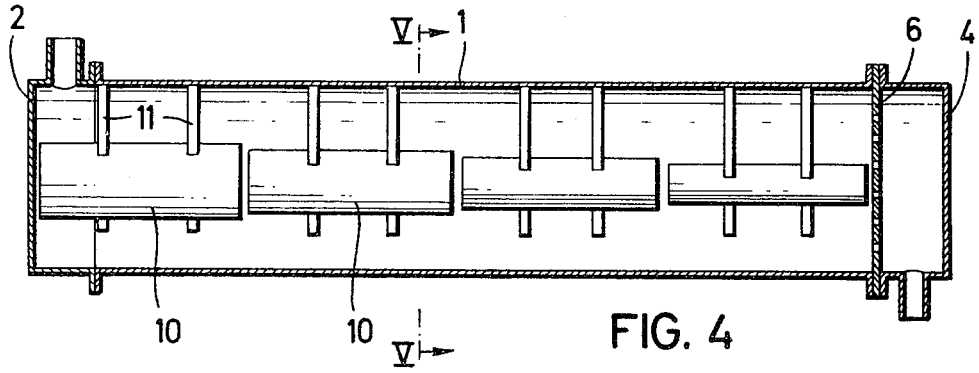
FIG. 4 is a longitudinal sectional view corresponding to that of FIG. 1 of another embodiment of the invention wherein excitation members are slid into the mill container and are free of any connection to the inner surface of the container.

In the longitudinal sectional view of FIG. 4, there is shown another embodiment of the vibrating mill of the invention wherein the crushing tube is provided at the ends thereof with an inlet chamber 2 and an outlet chamber 4 as in the embodiment of FIG. 1 and is again provided with a multiplicity of excitation members 10 which extend within the crushing tube 1 behind one another in longitudinal direction of the tube. The difference between the embodiment of FIG. 4 and that of FIG. 1 is that the excitation members of the embodiment of FIG. 4 are supported at the inner surface of the crushing tube 1 without any firm or fixed connection.

As is more clearly shown in FIG. 5, which is a cross-sectional view of FIG. 4, each excitation member 10 is in the form of a hollow cylinder and is provided at both ends thereof with, for example, three radially extending rod-like or crosspiece-like support elements 11. The support elements are of such length that the excitation members 10 can be inserted in a straight or rectilinear manner into the crushing tube 1 through one of the ends thereof with the support elements 11 acting as spacers for the excitation members. By this construction, it is possible to exchange the excitation members 10 individually in accordance to the extent to which they are subjected to wear.

The number of the excitation members that are located within the crushing tube depends essentially upon the length of the crushing tube. When the crushing tube is relatively short it is possible, for example, to provide a continuous excitation member which is then placed at various locations thereof along the longitudinal axis thereof with radially extending support elements. With such a construction it is then possible besides to arrange additional support elements in the vicinity of both ends of the excitation members, which in this case however need not lie in a plane perpendicular to the longitudinal axis of the crushing tube.

Depending upon the type of the material to be comminuted or ground it may be desirable, as shown in FIG. 4, to vary the diameter of the excitation members 7, 10 stepwise in the longitudinal direction of the grinding tube. It is also within the scope of the invention to have a continuously varying diameter along the excitation members 10 in the longitudinal direction of the crushing tube. In such case, although not illustrated in the figures, it is believed to be quite clear that the excitation members would have a substantially frustoconical construction or a taper which is uniformly decreasing from one end of the crushing tube to the other end thereof.

In the cross-sectional view of the modified construction shown in FIG. 6, there is shown an excitation member corresponding somewhat to the structure of the excitation members of FIGS. 4 and 5. However, in the embodiment of FIG. 6, the support elements 11 have free ends 12 that are provided with a respective base member 13 formed of wear-resistant material, such as rubber, plastic material or similar material, by means of which the support elements 11 are in engagement with the inner surface of the container wall 1.

FIG. 7 shows an enlarged sectional view of a vibrating mill corresponding to that of FIG. 4 but provided with so-called wear cylinder 14, namely a cylindrical sheet made of wear-resistant material which is in engagement with the cylindrical inner surface of the crusher tube 1. Such a wear cylinder 14 may be provided in each of the embodiments shown in FIGS. 1–6 but, in the interest of clarity, has been omitted from those figures. In those cases where a rotary motion of the excitation member 10 might be disadvantageous, for example, when the axis of the excitation member does not coincide with the axis of the crusher tube but rather is located below the axis of the crusher tube and is supposed to be immersed more deeply into the volume of comminuting or grinding media partially filling the crusher tube, it is advantageous to retain at least one of the support elements 11' at the inner surface of the container wall 1 in an upper region of the crushing tube. The simplest manner for effecting this is to make the support element 11' somewhat longer than the other two supporting elements 11 and to conform the width of at least the free end of the support element 11' to the width of a longitudinal gap extending axially along the wear cylinder 14 at an upper location thereof, as shown in FIG. 7, and to be thereby retained in that gap. With crusher tube linings that do not have such a gap, such as for example, with ceramic linings, the retention of the longer support elements 11' can be effected by providing suitable nose pieces or cams at the lining in a relatively simple manner. Also, it is possible with such a construction to exchange the worn excitation member or members of this construction by simply sliding the same out of the crusher tube and sliding a replacement excitation member into the same. This arrangement of the excitation member in the vibrating mill further permits the excitation member to be provided with cross sections of the shape shown in FIG. 3, which is accommodated or conforms to the shape of the volume of comminuting or grinding media 16 assumed thereby in the course of the circulation thereof during operation of the vibrating mill. Due to the fact that the rotary motion of the excitation member or members is eliminated, they need no longer be of rotationally symmetrical shape.

In order to set in vibration the vibratory mill constructed in accordance with the invention, bearings may be secured, for example, to the grinding tube 1. A drive shaft carrying unbalanced weights may extend through the bearings and may be connected through a universal joint to a drive motor, all of which are not illustrated in the drawings, but are nevertheless fully shown and described with respect to a vibratory mill having two grinding tubes in U.S. Pat. No. 3,212,722 to Maeder et al, which is assigned to the same assignee as that of the instant application.

As shown in FIG. 8, the hollow excitation members 7 are provided with hollow support elements 8 which are in turn connected to supply and discharge lines 15 for passing a cooling or heating heat transfer medium therethrough.

It is also with the scope of the invention, although not illustrated in the drawings, to provide an electrically energized heating coil in the interior of the excitation member. Heating or cooling is also possible with the construction shown in FIG. 7. In this case, the supply lines may be inserted axially into the excitation members with the condition, however, that they must have an elastic construction at the respective transition locations thereof.

We claim:

1. Grinding mill having at least one container partially filled with grinding media, and a plurality of excitation members extending spaced from one another in direction of the longitudinal axis of said container and disposed within said container so as to be surrounded by the grinding media received in said container, said excitation member being supported on the wall of said container by a plurality of separate rod-shaped support elements extending substantially radially from said excitation member and disposed in spaced relationship to one another in direction of said longitudinal axis.

2. Grinding mill according to claim 1, wherein the diameters of all said excitation members are not equal.

3. Vibrating mill having at least one container partially filled with grinding media, and at least one excitation member, closed on all sides thereof, extending in direction of the longitudinal axis of said container and disposed within said container so as to be surrounded by the grinding media received in said container, said excitation member being supported from above on the wall of said container by a plurality of separate rod-shaped support elements extending substantially radially from said excitation member and disposed in spaced relationship to one another in direction of said longitudinal axis.

4. Vibrating mill according to claim 3, wherein a plurality of said support elements are disposed in each of at least two planes extending perpendicularly to said longitudinal axis at least one of said support elements being firmly secured to said container wall on its inner surface.

5. Vibrating mill according to claim 3, wherein said excitation member is of hollow construction and the interior thereof is connected to inlet and outlet means for a fluid heat transfer medium.

6. Vibrating mill having at least one container partially filled with grinding media, and at least one excitation member extending in direction of the longitudinal axis of said container and disposed within said container so as to be surrounded by the grinding media received in said container, said excitation member being supported on the wall of said container by a plurality of separate rod-shaped support elements extending substantially radially from said excitation member and disposed in spaced relationship to one another in direction of said longitudinal axis, a plurality of said support elements being disposed in each of at least two planes extending perpendicularly to said longitudinal axis, said support elements being in engagement with the wall of said container free of any connection thereto.

7. Vibrating mill according to claim 6, wherein said plurality of support elements in each of said planes extending perpendicularly to said longitudinal axis is distributed uniformly about the periphery of said excitation member.

8. Vibrating mill according to claim 6, wherein said support elements have a respective end provided with a base member formed of wear-resistant material located in engagement with the inner surface of said container wall.

9. Vibrating mill according to claim 8, wherein said wear-resistant material is selected from the group consisting of rubber and plastic materials.

10. Vibrating mill having at least one container partially filled with grinding media, and at least one excitation member extending in direction of the longitudinal axis of said container and disposed within said container so as to be surrounded by the grinding media received in said container, said excitation member being supported on the wall of said container by a plurality of separate rod-shaped support elements extending substantially radially from said excitation member and disposed in spaced relationship to one another in direction of said longitudinal axis, said container being cylindrical, and including a cylindrical member formed of wear-resistant material received within said container in engagement with the cylindrical wall thereof, said cylindrical member having an axially extending gap formed therein, at least one of said support elements having an end located in said gap.

11. Vibrating mill having at least one container partially filled with grinding media, and at least one excitation member extending in direction of the longitudinal axis of said container and disposed within said container so as to be surrounded by the grinding media received in said container, said excitation member being supported on the wall of said container by a plurality of separate rod-shaped support elements extending substantially radially from said excitation member and disposed in spaced relationship to one another in direction of said longitudinal axis, said excitation member having a cross-sectional shape substantially conforming to the shape of the volume occupied by the charge of material to be comminuted in the travel path thereof during operation of the vibrating mill.

12. Method of producing a vibrating mill having a container with at least one compartment partially filled with grinding media which upon movement of the grinding media induced by movement of the container comminutes material introduced into the vibrating mill, which comprises disposing at least one excitation member closed on all sides thereof in the interior region of said grinding media, extending in direction of longitudinal axis of said container and communicating with and supported from above on the wall of said container by a plurality of separate rod-shaped support elements extending substantially radially from said excitation member and disposed in spaced relationship to one another in direction of said longitudinal axis so as to transmit movement of said container to the interior region of said grinding media.

13. A method according to claim 12 which comprises disposing a plurality of said support elements in each of at least two planes extending perpendicularly to said longitudinal axis, at least one of said support elements being firmly secured to said container wall on its inner surface.

14. A method according to claim 12, wherein said excitation member is of hollow construction, and which includes connecting the interior of the hollow excitation member to inlet and outlet means for a fluid heat transfer medium.

15. Method of producing a vibrating mill having a container with at least one compartment partially filled with grinding media which upon movement of the grinding media induced by movement of the container comminutes material introduced into the vibrating mill, which comprises disposing at least one excitation member in the interior region of said grinding media, extending in direction of longitudinal axis of said container and communicating with and supported on the wall of said container by a plurality of separate rod-shaped support elements extending substantially radially from said excitation member and disposed in spaced relationship to one another in direction of said longitudinal axis so as to transmit movement of said container to the interior region of said grinding media, a plurality of said support elements being disposed in each of at least two planes extending perpendicularly to said longitudinal axis, said support elements being in engagement with the wall of said container free of any connection thereto.

16. Method of producing a vibrating mill having a container with at least one compartment partially filled with grinding media which upon movement of the grinding media induced by movement of the container comminutes material introduced into the vibrating mill, which comprises disposing at least one excitation member in the interior region of said grinding media, extending in direction of longitudinal axis of said container and communicating with and supported on the wall of said container by a plurality of separate rod-shaped support elements extending substantially radially from said excitation member and disposed in spaced relationship to one another in direction of said longitudinal axis so as to transmit movement of said container to the interior region of said grinding media, said container being cylindrical, and which includes disposing a cylindrical member formed of wear-resistant material within said container in engagement with the cylindrical wall thereof, said cylindrical member having an axially extending gap formed therein, at least one of said support elements having an end located in said gap.

17. Method of producing a vibrating mill having a container with at least one compartment partially filled with grinding media which upon movement of the grinding media induced by movement of the container comminutes material introduced into the vibrating mill, which comprises disposing at least one excitation member in the interior region of said grinding media, extending in direction of longitudinal axis of said container and communicating with and supported on the wall of said container by a plurality of separate rod-shaped support elements extending substantially radially from said excitation member and disposed in spaced relationship to one another in direction of said longitudinal axis so as to transmit movement of said container to the interior region of said grinding media, said excitation member having a cross-sectional shape substantially conforming to the shape of the volume occupied by the charge of material to be comminuted in the travel path thereof during operation of the vibrating mill.

* * * * *